US009138988B2

(12) United States Patent
Usuda et al.

(10) Patent No.: US 9,138,988 B2
(45) Date of Patent: Sep. 22, 2015

(54) PRINTING APPARATUS, PRINTING METHOD AND PRINTED MATTER

(71) Applicant: SEIKO EPSON CORPORATION, Tokyo (JP)

(72) Inventors: Hidenori Usuda, Matsumoto (JP); Takayoshi Kagata, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 178 days.

(21) Appl. No.: 13/756,110

(22) Filed: Jan. 31, 2013

(65) Prior Publication Data

US 2013/0201239 A1 Aug. 8, 2013

(30) Foreign Application Priority Data

Feb. 3, 2012 (JP) ..... 2012-022270

(51) Int. Cl.
*B41J 2/21* (2006.01)
*B41J 2/04* (2006.01)

(52) U.S. Cl.
CPC *B41J 2/04* (2013.01); *B41J 2/2114* (2013.01); *B41J 2/2128* (2013.01)

(58) Field of Classification Search
USPC ..... 347/100, 101, 102; 428/195.1; 283/72–114
See application file for complete search history.

(56) References Cited

U.S. PATENT DOCUMENTS

| | | | | |
|---|---|---|---|---|
| 6,863,374 | B2 | 3/2005 | Yamazaki et al. | 347/43 |
| 7,121,660 | B2 * | 10/2006 | Ide et al. | 347/101 |
| 7,651,215 | B2 * | 1/2010 | Hoshino | 347/102 |
| 8,506,068 | B2 * | 8/2013 | Mimura | 347/100 |
| 2005/0046684 | A1 * | 3/2005 | Yoneyama | 347/102 |
| 2007/0281136 | A1 * | 12/2007 | Hampden-Smith et al. | 428/195.1 |
| 2011/0032299 | A1 | 2/2011 | Mimura | 347/15 |

FOREIGN PATENT DOCUMENTS

| | | |
|---|---|---|
| JP | 10-000850 | 1/1996 |
| JP | 08-150800 | 6/1996 |
| JP | 2004-001410 | 1/2004 |
| JP | 2004-122496 | 4/2004 |
| JP | 2004-122505 | 4/2004 |
| JP | 2011-037015 | 2/2011 |

* cited by examiner

*Primary Examiner* — Matthew W Such
*Assistant Examiner* — Tuan A Hoang
(74) *Attorney, Agent, or Firm* — DLA PIPER LLP (US)

(57) ABSTRACT

A printing apparatus includes a first nozzle through which to eject color ink, a second nozzle through which to eject clear ink, a control unit that performs control, in a manner that ejects the color ink onto a glittering layer through the first nozzle, and ejects the clear ink onto the color ink through the second nozzle, at the time of forming an image on a medium on which the glittering layer is formed, in which the control unit controls ejection of the clear ink through the second nozzle in such a manner that an amount of the clear ink to be ejected onto the color ink varies according to a light absorption rate of the color ink.

8 Claims, 7 Drawing Sheets

PRINTING APPARATUS, PRINTING METHOD AND PRINTED MATTER

CROSS-REFERENCE TO RELATED APPLICATIONS

This application claims priority to Japanese Patent Application No. 2012-022270 filed on Feb. 3, 2012. The entire disclosure of Japanese Patent Application No. 2012-022270 is hereby incorporated herein by reference.

BACKGROUND

1. Technical Field

The present invention relates to a printing apparatus, a printing method and a printed matter.

2. Related Art

An ink jet type printer is in wide use, which forms an image by ejecting ink. With regard to the ink jet type printer like this, a form of printing is also considered in which the metallic tone printing is performed by ejecting metallic ink and color ink onto a medium.

JP-A-2004-122505 discloses that a printed matter is provided which is printed in such a manner that at least one color of a print portion printed in multiple colors is determined as a latent image print portion and the latent image print portion has a greater amount of specular reflection than other print portions. JP-A-8-150800 discloses that a flat portion which specularly reflects light in a concave and convex pattern is formed, and in a case where this flat portion is color-copied, a copy of the flat portion appears in black. Furthermore, JP-A-10-850 discloses that color is printed on a metallic base, but the color does not cover the whole metallic base.

JP-A-2004-122496 discloses that glossiness is changed by controlling the degree to which droplets are integrated into one piece. JP-A-2011-37015 discloses that an amount of clear ink is adjusted based on an amount of color ink. JP-A-2004-1410 discloses that an amount of improved ink is adjusted based on an amount of color ink discharged.

A copy machine performs the copying by detecting color due to diffuse reflection light. The case is considered where an image is formed by ejecting the color ink onto a glittering layer such as a metallic layer. In the case where the color ink is not present on the glittering layer, most of incident light turns into specular reflection light and the copy machine may not detect the diffuse reflection light. As a result, a copy of this portion is in black. Furthermore, in the case where the image with a high light absorption rate is formed on the glittering layer, the amount of the diffuse reflection light is also small because the amount of reflection light is small, and a copy of this portion is also in near black color. On the other hand, in the case where the image with a low light absorption rate is formed on the glittering layer, the color copying of this portion is appropriately performed because the amount of the diffuse reflection light is large.

However, the case is considered where the performance of the color copying needs to be made difficult out of concern for security. That is, it is preferable that a printed matter which is difficult to copy is provided.

SUMMARY

An advantage of some aspects of the invention is to provide a printed matter that is difficult to copy.

According to an aspect of the invention, there is provided a printing apparatus including a first nozzle through which to eject color ink, a second nozzle through which to eject clear ink, and a control unit that performs control, in a manner that ejects the color ink onto a glittering layer through the first nozzle, and ejects the clear ink onto the color ink through the second nozzle, at the time of forming an image on a medium on which the glittering layer is formed, in which the control unit controls ejection of the ink through the second nozzle in such a manner that an amount of the clear ink to be ejected onto the color ink varies according to a light absorption rate of the color ink.

Other features of the invention are made definite by descriptions of the present specification and the drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
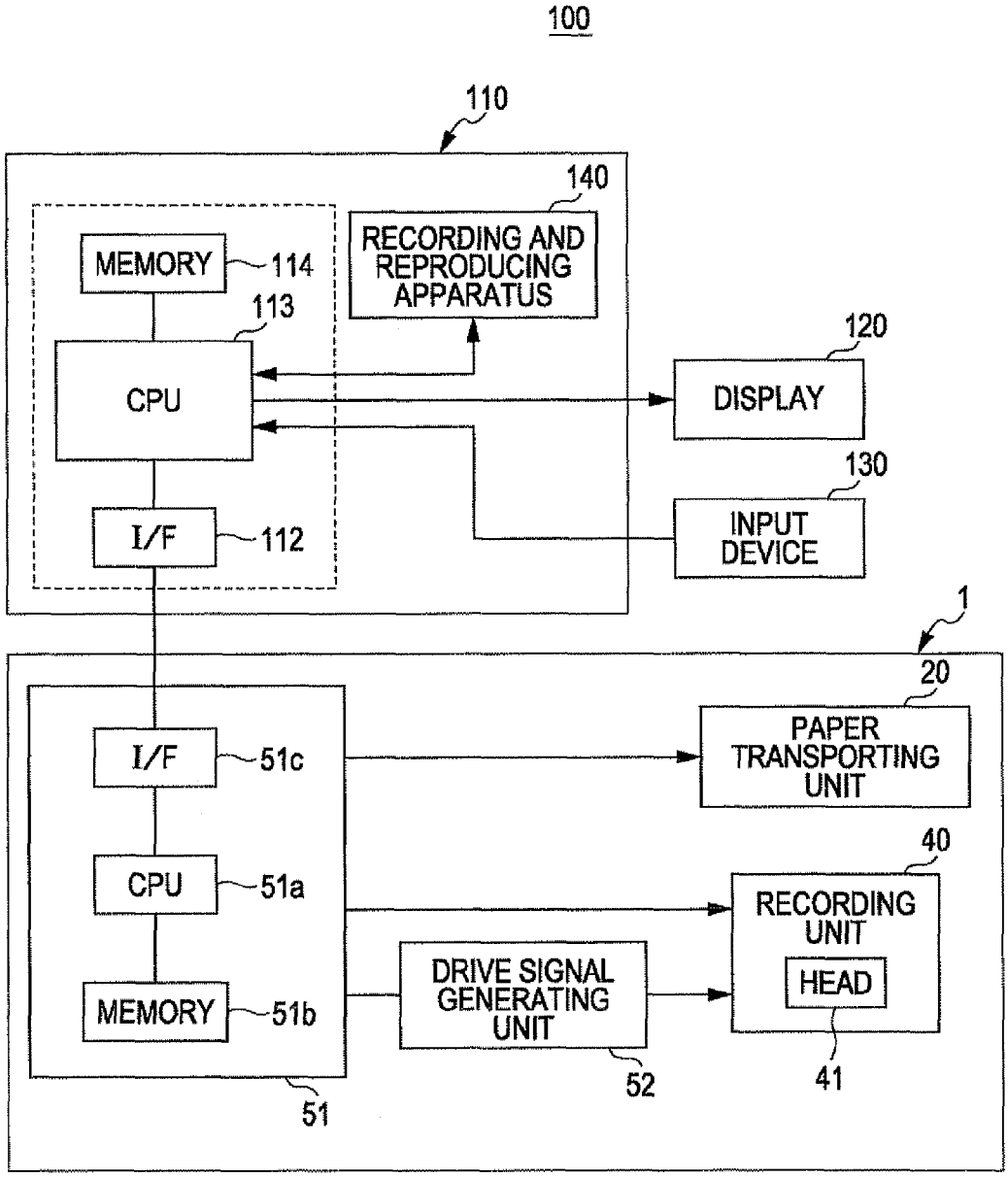
FIG. 1 is a block diagram illustrating a printing system according to the present embodiment.

The following matters, at least, are made definite by the descriptions of the present specification and the accompanying drawings. That is, a printing apparatus includes a first nozzle through which to eject color ink, a second nozzle through which to eject clear ink, and a control unit that performs control, in a manner that ejects the color ink onto the glittering layer through the first nozzle, and ejects the clear ink onto the color ink through the second nozzle, at the time of forming an image on a medium on which a glittering layer is formed, in which the control unit controls ejection of the ink through the second nozzle in such a manner that an amount of the clear ink to be ejected onto the color ink varies according to a light absorption rate of the color ink.

By doing this, the amount of the clear ink to be ejected onto the color ink is able to vary according to the light absorption rate of the color ink, and thus, the performance of the copying may be made difficult by adjusting the amount of the clear ink and increasing an amount of specular reflection in a case of the color ink with a low light absorption rate. And a printed matter that is difficult to copy may be obtained.

In the printing apparatus, which further includes a third nozzle that ejects the glitter ink, the control unit forms the glitter ink layer by ejecting the glitter ink through the third nozzle.

By doing this, the printing apparatus may form the glitter ink layer.

Furthermore, it is preferable that the control unit performs the control in such a manner that a first amount of the clear ink is ejected onto the color ink with a first light absorption rate through the second nozzle, and a second amount of the clear ink larger than the first amount is ejected onto the color ink with a second light absorption rate lower than the first light absorption rate through the second nozzle.

In the case of the color ink with a low light absorption rate, the copying of the color is easy to perform because an amount of the diffuse reflection light is large, but copying may be made difficult by increasing the amount of specular reflection by ejecting a large amount of the clear ink onto the color ink with the low light absorption rate.

Furthermore, it is preferable that the control unit controls the ejection of the clear ink through the second nozzle in such a manner that droplets of the clear ink that land on the color ink with the second light absorption rate, are integrated into one piece on the color ink with the second light absorption rate.

By doing this, the surface may be leveled (flattened) and thus the amount of the specular reflection may be increased by ejecting the large amount of the clear ink onto the color ink with the low light absorption rate, to such an extent that landed droplets of the clear ink are integrated into one piece. And the copying of the image formed with the color ink may be made difficult to perform.

Furthermore, it is preferable that the control unit controls the ejection of the clear ink through the second nozzle in such a manner that droplets of the clear ink that land on the color ink with a first light absorption rate, are at intervals on the color ink with the first light absorption rate.

By doing this, the specular reflection light may be adjusted by ejecting the clear ink in such an extent that droplets of the clear ink are at intervals on the color ink with a high light absorption rate.

Furthermore, it is preferable that the clear ink is ink that is hardened by light, and a light emitting unit, which emits light hardening the clear ink, is also included.

By doing this, the timing of the clear ink being hardened may be controlled. And the degree to which the droplets of the landed clear ink are leveled (flattened) may be controlled.

Furthermore, the following matter is at least made clear by the descriptions of the present specification and the accompanying drawings. That is, a printing method includes ejecting color ink onto a glittering layer on a medium on which the glittering layer is formed, and ejecting clear ink on the color ink, in which an amount of the clear ink to be ejected onto the color ink varies according to a light absorption rate of the color ink.

By doing this, since the amount of the clear ink ejected onto the color ink may be varied according to the light absorption rate of the color ink, copying may be made difficult by adjusting the amount of the clear ink, thereby increasing the amount of specular reflection in the case of the color ink with a low light absorption rate. And the printed matter that is difficult to copy may be obtained.

Furthermore, the following matters are at least made clear by the descriptions of the present specification and the accompanying drawings. That is, a printed matter is provided in which color ink is ejected onto a glittering layer on a medium on which the glittering layer is formed, clear ink is ejected onto the color ink, and an amount of the clear ink to be ejected onto the color ink varies according to a light absorption rate of the color ink.

By doing this, since the amount of the clear ink to be ejected onto the color ink is able to vary according to the light absorption rate of the color ink, the performance of the copying may be made difficult by adjusting the amount of the clear ink and increasing an amount of specular reflection in a case of the color ink with a low light absorption rate. And the printed matter that is difficult to copy may be provided.

Embodiment

FIG. 1 is a block diagram illustrating a printing system 100 according to the present embodiment; A general configuration of the printing system 100 according to the present embodiment is described below referring to this.

The printing system 100 has an ink jet printer 1 (hereinafter referred to as a "printer 1" for short) as the printing apparatus, a computer 110, a display 120, and an input device 130. The printer 1 prints an image on a medium such as a sheet of paper, a piece of cloth, and a film. The computer 110 is connected to the printer 1 via an interface 112 in a communication-enabled manner. And in order to cause the printer 1 to print the image, the computer 110 outputs print data, which corresponds to that image, to the printer 1. The computer 110 includes a CPU 113, a memory 114, the interface 112, and a recording and reproducing device 140. And computer programs, such as an application program and a printer driver, are installed. The recording and reproducing device 140, for example, is a flexible disk drive device and a CD-ROM drive device.

The display 120, for example, is a liquid crystal monitor. The display 120, for example, is one for displaying a user interface of a computer program. The input device 130, for example, is a keyboard or a mouse.

Figure 3:
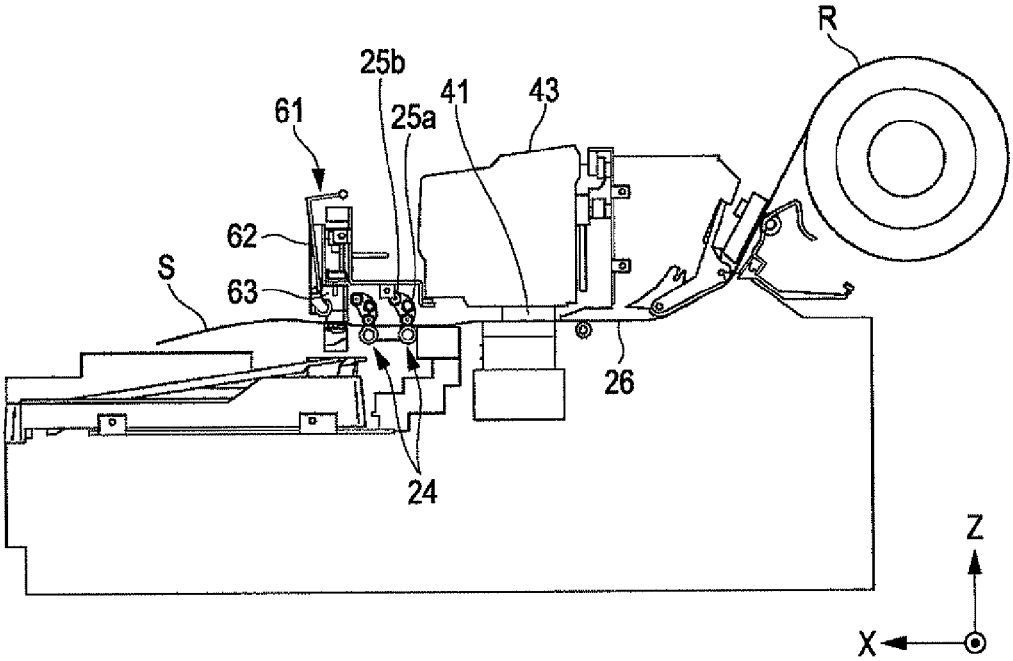
FIG. 3 is a side view illustrating the inside of the ink jet printer according the present embodiment.

The ink jet printer 1 includes a paper transporting unit 20, a recording unit 40, a control unit 51, and a drive signal generating unit 52. The paper transporting unit 20 supplies the medium from a roller, around which a roll of paper R (as illustrated in FIG. 3) is wound, to the recording unit 40 and discharges the medium after the printing. The recording unit 40, as described below, moves a carriage 43 (as illustrated in FIG. 3), which is equipped with a head 41, and performs the forming of the image on the medium by ejecting the ink from the head 41.

Furthermore, the ink jet printer 1 includes the control unit 51 that controls the operation of each of the constituent elements, in an integrating manner. The control unit 51 includes a CPU 51*a* that performs, for example, a calculation, a memory 51*b* that stores, for example, a program and a calculation result, and an interface 51*c* that performs the communication with an external apparatus. The control unit 51 controls the paper transporting unit 20, the recording unit 40, and the drive signal generating circuit 52.

The drive signal generating unit 52 supplies a drive signal COM to each piezoelectric element PZT (to be described below) of the head 41 of the recording unit 40. Digital data, which specifies the shape of the drive signal COM, is sent from the control unit 51 to the drive signal generating unit 52, and the drive signal generating unit 52 generates the drive signal COM that is a voltage waveform, based waveform based on the digital data.

Figure 2:
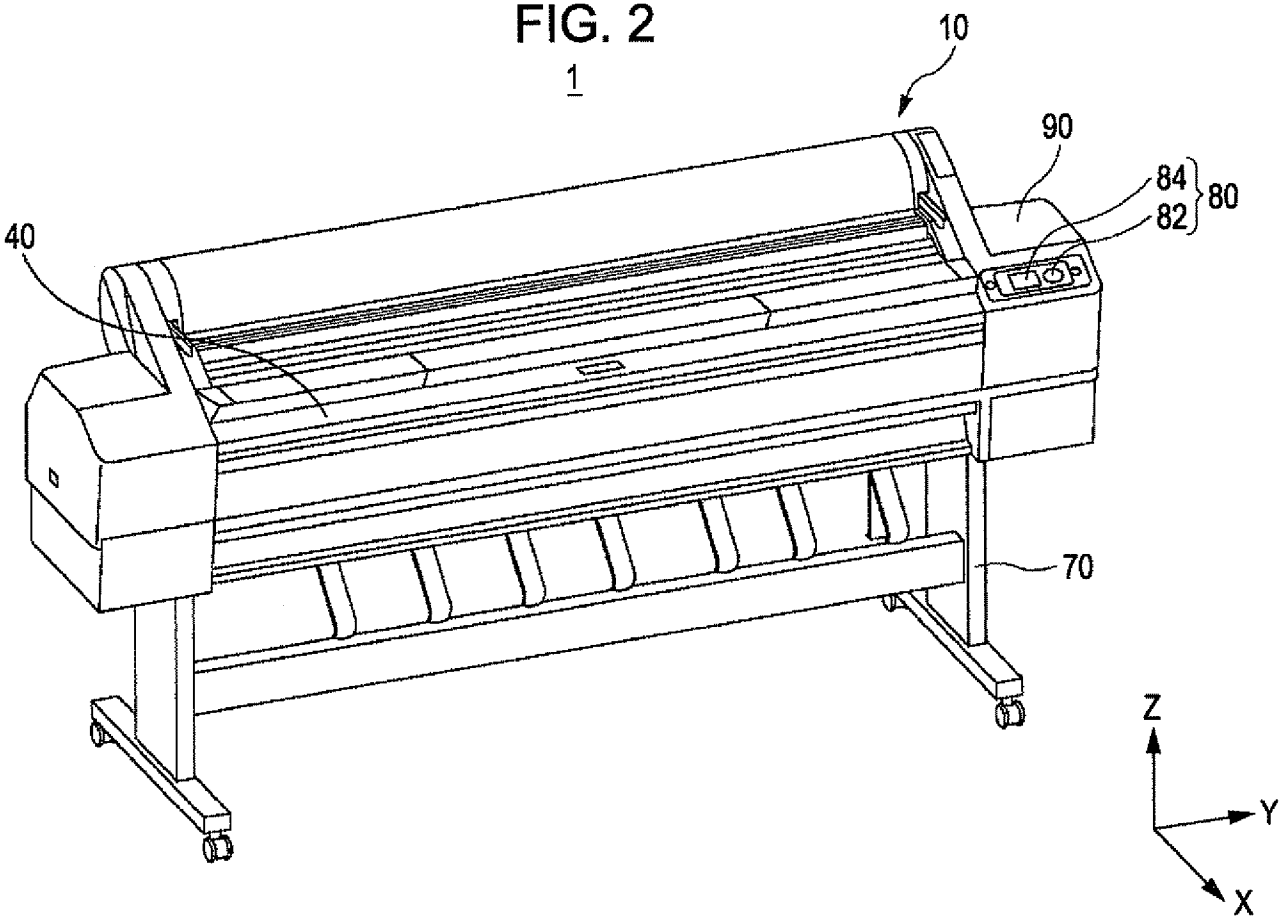
FIG. 2 is a perspective view illustrating an ink jet printer according to the present embodiment.

FIG. 2 is a perspective view illustrating the ink jet printer 1 according the present embodiment. FIG. 3 is a side view illustrating the inside of the ink jet printer 1 according the present embodiment. In the following description, the transporting direction (the discharging direction) of the medium is referred to as the X-axis direction, the width direction (the direction perpendicular to the paper in FIG. 3) of a transportation path 26 intersecting the X axis direction as the Y axis direction and the vertical direction intersecting the X axis direction and Y axis direction as the Z axis direction.

As illustrated in FIG. 2, the ink jet printer 1 includes the recording unit 40 that is arranged in such a manner that the longitudinal direction is the horizontal direction, a housing 90 that is mounted on an end portion of the recording unit 40, a load portion 10 mounted above the recording unit 40, and a leg portion 70 supporting the recording unit 40 and the housing 90 from below.

The recording unit 40 includes the head 41 that ejects the ink with respect to the medium that arrives by transportation along the transportation path 26. The head 41 is mounted on the carriage 43 that is freely movable in the width direction of the transportation path 26. An ink cartridge, not illustrated, which stores the ink, is mounted on the printer 1. The ink of each color is supplied from the ink cartridge to the head 41. The head 41 includes multiple rows of nozzles and is configured in such a manner that the ink of a predetermined color (for example, yellow (Y), magenta (M), cyan (C), black (K), clear (Cl), metallic (Me)) is able to be ejected through each row of nozzles. The head 41 performs the forming of the image, which records, for example, predetermined image information and predetermined letter information by ejecting the ink with respect to the record surface of the medium.

The medium, on which the image formation is performed by the recording unit 40, is discharged from a discharge roller 24. The discharge roller 24 includes a mechanism, by which a roller performing the nipping according to a kind of paper, is changed to an incision roller 25*a* or a rolling roller 25*b*.

A cutting device 61, which cuts the discharged medium to the predetermined size, is provided in the downstream side of the discharge roller 24. The cutting device 61 has a regulating member 62 that regulates a height position of the discharged medium, and a cutting unit 63 that cuts the medium by moving in the width direction (the Y axis direction), intersecting the discharging direction (the X axis direction) of the medium.

An operating panel 80 is arranged on the upper surface of the housing 90. The operating panel 80 includes a group of switches 82 that a user operates and further includes a displaying unit 84 displaying the operation status of the printer 1. Accordingly, when the side to which the operating panel 80 and the cartridge holder are arranged is defined as the front side, the user operates the printer 1 from this front side.

Figure 4:
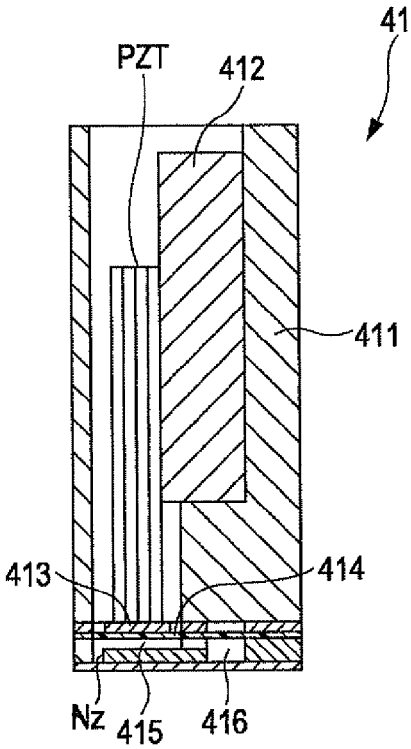
FIG. 4 is a cross-sectional view illustrating the construction of a head.

FIG. 4 is a cross-sectional view illustrating the construction of the head 41. A flow channel 416 is formed in the head 41 and the ink is supplied through the flow channel 416. An adhesion substrate 412 is fixed to a case 411 of the head 41. The adhesion substrate 412 is in the rectangular-shaped plate, and further the piezoelectric element PZT adheres to one surface of the adhesion substrate 412. An island portion 413 is connected to the tip of the piezoelectric element PZT, and an elastic region is formed from an elastic film 414, in the vicinity of the island portion 413.

The piezoelectric element PZT is transformed by applying a potential difference between the opposing electrodes. In this example, the piezoelectric element PZT expands and contracts in the longitudinal direction. An amount of expansion and contraction is determined according to the potential of the piezoelectric element PZT. And when the piezoelectric element PZT expands and contracts, the island portion 413 is pushed to the side of a pressure chamber 415 and is pulled in the opposite direction. At this time, since the elastic film 414 in the vicinity of the island portion is transformed, the ink may be efficiently ejected through the nozzle Nz.

With a configuration like this, multiple sizes of ink may be ejected by adjusting the amplitude of the drive signal that is to be applied to the piezoelectric element PZT. Accordingly, an amount of ink to be ejected (the ejection duty) may be appropriately controlled.

Figure 5:
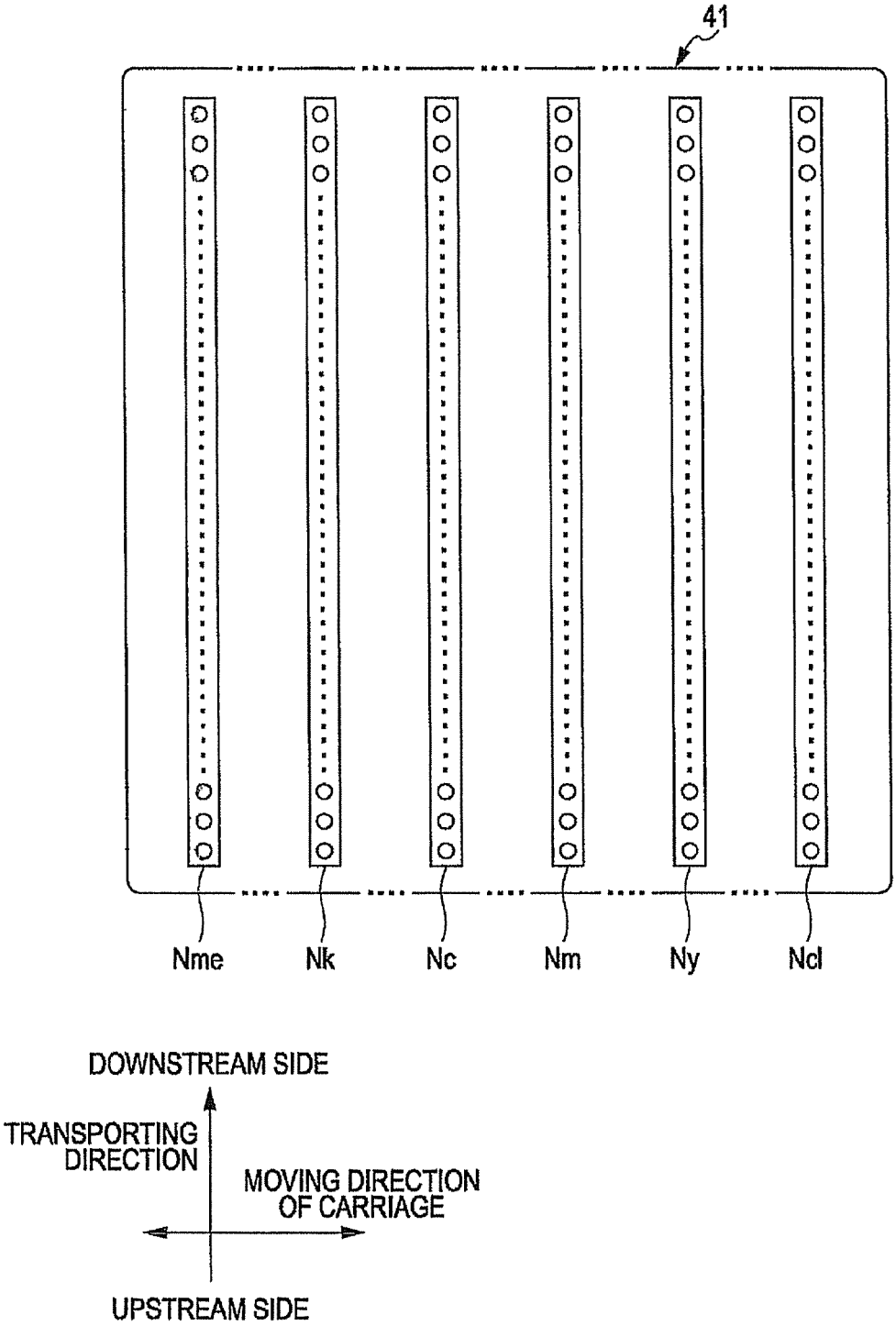
FIG. 5 is a view illustrating a nozzle of the head.

FIG. 5 is a view illustrating nozzles of the head 41. From the head 41, according to the present embodiment, six kinds of ink which are yellow ink Y, magenta ink M, cyan ink C, black ink K, metallic ink Me, and clear ink CI, may be ejected. The clear ink CI is transparent or translucent ink. Additionally, the yellow ink Y, the magenta ink M, the cyan ink C, and the black ink K are referred to as the color ink Go.

The metallic ink Me is described. The metallic ink Me contains a metallic pigment and an organic solvent. As long as the metallic pigment has a function, such as metallic glossiness, the metallic pigment is not given any especial limitation, but aluminum, or aluminum alloy, or silver, or silver alloy is preferable. The metallic ink is included in the glitter ink. At this point, a glitter ink has a surface characteristic that creates the specular reflection of light. Additionally, the pigment contained in the glitter ink is not limited to the metallic pigment as described above, but may be any ink that exhibits the above described surface characteristic. Furthermore, the glittering layer, which appears in the following description, means a layer that has the surface characteristic which creates the specular reflection of light.

The ejection of the clear ink Cl through the clear ink nozzle row Ncl, the ejection of the color ink Co through the color ink nozzle row and the ejection of the metallic ink through the metallic ink nozzle row Nme are controlled by the control unit 51 described above.

An example of the six nozzle rows is illustrated in FIG. 5. While the head 41 is moved in the moving direction of the carriage, the clear ink is ejected through the nozzles in the clear ink nozzle row Ncl. Furthermore, the black ink is ejected through the nozzles in the black ink nozzle row Nk. Furthermore, the cyan ink is ejected through the nozzles in the cyan ink nozzle row Nc. Furthermore, the magenta ink is ejected through the nozzles in the magenta ink nozzle row Nm. Furthermore, the yellow ink is ejected through the nozzles in the yellow ink nozzle row Ny. Furthermore, the metallic ink is ejected through the nozzles in the metallic ink nozzle row Nme.

With the configuration like this, the metallic ink Me may be ejected onto the medium and the color ink Co may be ejected onto the metallic ink Me. Furthermore, the clear ink C1 may be ejected onto the color ink Co.

Figure 6:
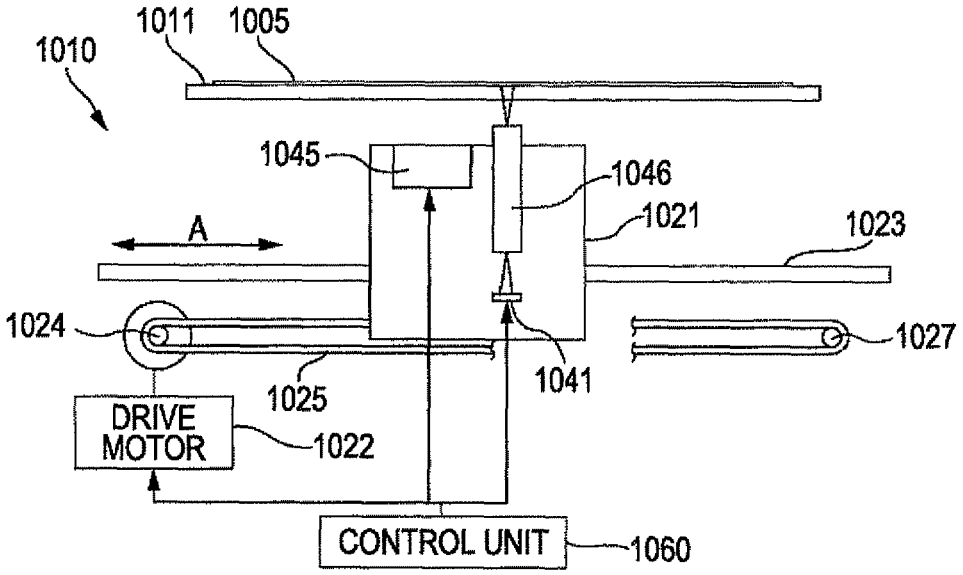
FIG. 6 is a view illustrating a reading mechanism in a copy apparatus.

FIG. 6 is a view illustrating a reading mechanism in a copy apparatus. A scanner 1010 includes a carriage 1021 and a carriage moving mechanism that moves a carriage 1021 in parallel along the A direction indicated by the arrow in the drawing (the secondary scanning direction) while maintaining a predetermined interval with respect to the manuscript supporter 1011 below a manuscript supporter 1011.

The carriage moving mechanism includes a guide 1023 that guides the movement of the carriage 1021 while supporting the carriage 1021. Furthermore, the carriage moving mechanism includes a belt 1025 connected to the carriage 1021, a shaft 1024 and a pulley 1027 on which the belt 1025 is placed and a drive motor 1022 to rotatably drive the shaft 1024. The drive motor 1022 is drive-controlled by a control signal from the control unit 1060.

Each unit of the reading mechanism is included in the carriage 1021. An exposure lamp 1045, as a light source, which emits light with respect to a manuscript 1005 via the manuscript supporter 1011, a lens 1046, on which the diffuse reflection light reflected by the manuscript 1005 is incident, and an image sensor 1041, which receives the diffuse reflection light importing into the carriage 1021 via the lens 1046, are provided in the carriage 1021.

The image sensor 1041 is configured by a linear CCD sensor in which photoelectric transducers, such as photo diodes, which convert an optical signal to an electrical signal, are arranged in a row. Data on the image, read by the image sensor 1041 is output to the control unit 1060. The copy apparatus performs the copying on the medium such as a sheet of paper, based on the diffuse reflection light data input to the control unit.

Figure 7:
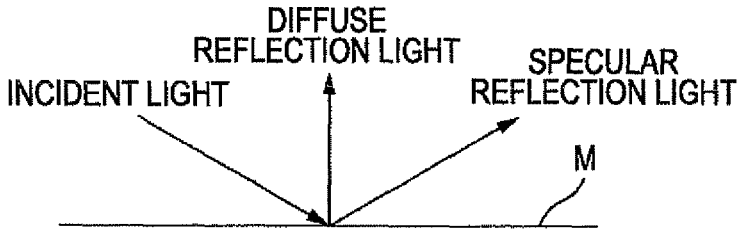
FIG. 7 is a view illustrating specular reflection light and diffuse reflection light.

FIG. 7 is a view illustrating the specular reflection light and the diffuse reflection light. The reflection of the incident light on the medium M as the specular reflection light (the specular reflection light) and the diffuse reflection light are illustrated in the drawings. As described above, in the reading mechanism, the diffuse reflection light, which is reflected by the incident light from the exposure lamp 1045 being diffused in the medium, is read by the image sensor 1041. Consequently, when a rate of the diffuse reflection light to the reflection light is appropriate, the copying of the medium is appropriately performed. On the other hand, in a case where a rate of the specular reflection light to the reflection light is high and the rate of the diffuse reflection light is low, the copying of the medium is not properly performed because an amount of the diffuse reflection light is insufficient. Specifically, since the amount of the diffuse reflection light is small, the black copying, as a whole, is performed.

The surface of the glittering layer, such as the metallic layer, is enumerated as an example in which the rate of the diffuse reflection light is low and the rate of the specular reflection light is high. In the surface of the metallic layer like this, most of the incident light turns into the specular reflection light. Because of this, in a case where the metallic surface is copied, the copy machine may not detect the diffuse reflection light, and as a result the blackish copying is performed.

Furthermore, in a case where the ink with a small amount of light reflection, such as a cyan ink, is printed on the surface of the metallic layer, the amount of light reflection is originally small, but the amount of the diffuse reflection light as a whole is small because even in a case where one part of the incident light is reflected at the glittering surface the incident light turns into the specular reflection light. Consequently, in the copy machine that performs the copying by detecting the diffuse reflection light, the blackish copying is performed.

That is, in both of the case where the surface of the metallic layer is copied, and the case where the ink with the high light absorption rate on the metallic layer, such as the cyan ink, is copied, the same blackish images are output as copies. Therefore, it is difficult to distinguish between both of them, and as a result the printed matter with a high security level, of which the copying is not possible, is provided.

On the other hand, for example, generally, the light absorption rate of the yellow ink is low. That is, this means that a large amount of light reflection is present. In a case where the yellow ink like this is ejected at the surface of the metallic layer, the reflection of light is performed in the yellow ink itself. Although the amount of light reflection due to the yellow ink is large, a component of the diffuse reflection light component has a greater amount than a component of the specular reflection light. As described above, in the copy machine, the copying is performed by detecting the diffuse reflection light, but the amount of the diffuse reflection light is also large because the amount of light reflection is originally large and thus the copying is easy to perform, even though the metallic ink is present as a base positioned underneath. That is, the copying may be appropriately performed as a result and thus the printed matter with a low security level is provided.

In the situation like this, for example, even in a case where the image is formed by ejecting the ink with the low light absorption rate, such as the yellow ink, onto the metallic layer, it is preferable to provide the printed matter with the high security level by making the performance of the copying difficult. According to the embodiment described below, even in a case where the ink with the low light absorption rate is used, the performance of the color copying thereof is made difficult.

Figure 8:
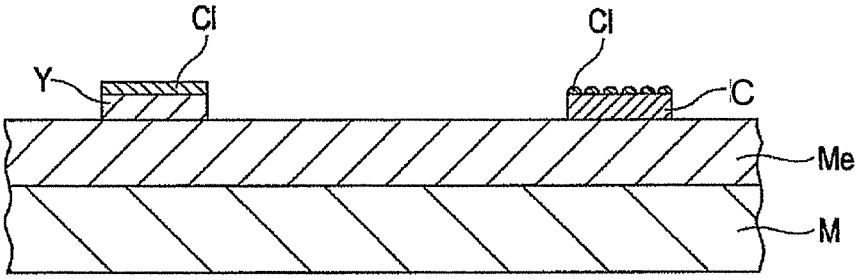
FIG. 8 is a cross-sectional view illustrating a printed matter according to the present embodiment.

FIG. 8 is a cross-sectional view illustrating the printed matter according to the present embodiment. The formation of the metallic layer on the medium M (for example, a sheet of paper) by the metallic ink Me is illustrated in the drawings. In addition, the metallic layer may be formed not by the metallic ink Me, and be formed in advance by the glitter ink on the medium M.

The formation of the image on the metallic layer by the ink with the low light absorption rate, for example, by the yellow ink Y is illustrated in FIG. 8. Furthermore, the image is formed on the metallic layer by the ink with the high light absorption rate, for example, by the cyan ink C.

And the large amount of the clear ink C1 is ejected onto the ink with the low light absorption rate, and on the other hand, a small amount of the clear ink Cl is ejected onto the ink with the high light absorption rate. By doing this, the copying of the color image formed on the metallic layer is difficult to perform. The reflection light in a case of ejecting the clear ink in this manner is described below.

Figure 9A:
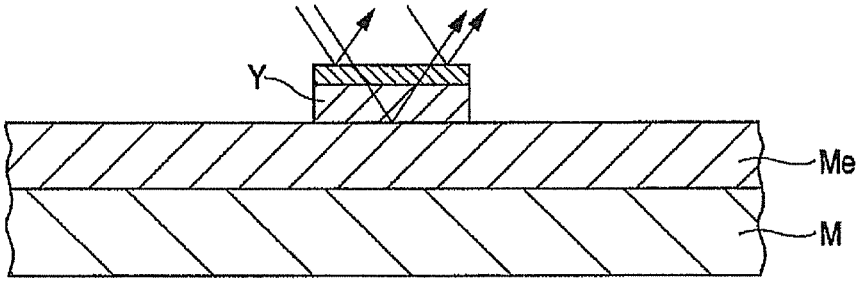
FIGS. 9A and 9B are a view illustrating reflection light due to yellow ink and clear ink, and a view illustrating the reflection light due to cyan ink and the clear ink, respectively.

FIG. 9A is a view illustrating the reflection light due to the yellow ink Y and the clear ink C1. The state is illustrated in the drawings, in which the layer of the metallic ink Me is formed on the medium M, and the image resulting from the yellow ink Y is formed on the metallic ink Me. Furthermore, the state is illustrated in which the clear ink C1 is further ejected onto the yellow ink Y in such an extent that droplets of the clear ink are leveled (flattened).

When a large amount of the clear ink C1 is ejected onto the ink with the low light absorption rate in this manner, a layer of the clear ink C1 is formed. Since the surface of the layer of the clear ink C1 is flattened, and further since the layer of the clear ink C1 is formed from the transparent ink, a large amount of the specular reflection occurs in this layer. Because of this, since a large amount of the incident light is specularly reflected in the layer of the clear ink C1, the amount of the diffuse reflection light is small in the layer of the yellow ink Y as well, and as a result, the copy machine has difficulty detecting the diffuse reflection light. And in this case, a comparatively blackish image is also output as a copy. In addition, the printed matter like this may be visually recognized as a usual image in appearance.

By doing what is illustrated in FIG. 9A, the copying of the image resulting from the yellow ink Y is difficult to perform, and even if the copying is performed, the blackish copying is performed. However, a completely black copying is not performed. Consequently, it is preferable that the distinction between patterns is made difficult in a copy by matching this color with other ink colors, in terms of the degree of blackness.

Figure 9B:
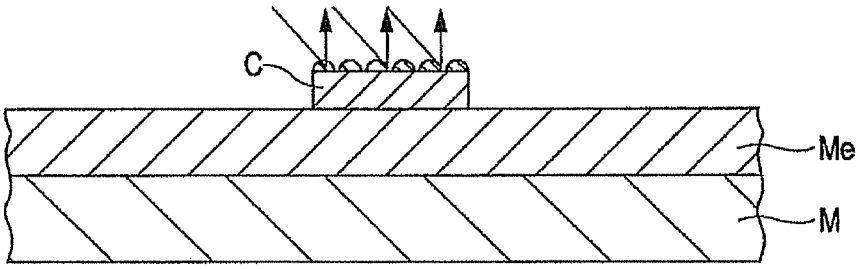

FIG. 9B is a view illustrating the reflection light due to the cyan ink C and the clear ink C1. The state is illustrated in the drawings, in which the layer of the metallic ink Me is formed on the medium M, and further the image resulting from the cyan ink C is formed on the metallic ink Me. Furthermore, the state is illustrated in which the clear ink C1 is additionally formed in the shape of a dot on the cyan ink C.

When a small amount of the clear ink C1 is ejected onto the ink with the high light absorption rate in this manner, a dot resulting from the clear ink C1 is formed. The hemispherical shape, which the dot resulting from the clear ink C1 takes on, makes the incident light turn into the diffuse reflection light.

And the degree of blackness may be adjusted when performing the copying, by adjusting the amount of the specular reflection light and the amount of the diffuse reflection light. That is, by matching the ink colors, in terms of the degree of blackness of a copy, it is possible that the distinction between both of the ink colors is made difficult and thus the distinction between the patterns is not made possible. And the copying may be more difficult to perform.

In the embodiment described above, for the purpose of a brief description, the case is taken as an example, where the image resulting from the yellow ink Y and the image resulting from the cyan ink C are separately formed. However, in a case where multiple droplets of color ink are combined to form the color image, the printing may be performed as follows.

Figure 10:
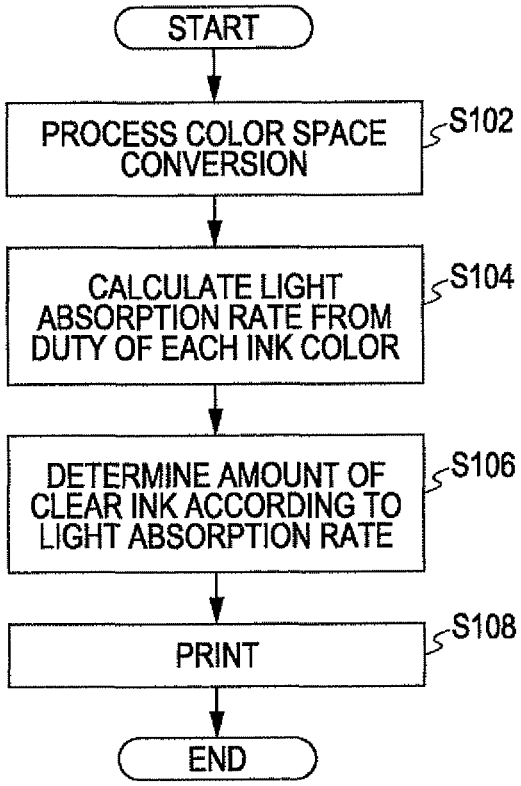
FIG. 10 is a flow chart illustrating a printing method according to the present embodiment.

FIG. 10 is a flow chart illustrating a printing method according to the present embodiment. According to the present embodiment, the creation of the image resulting from RGB color space is performed in a software that is running on the computer 110 according to the present embodiment. When a print command is transmitted from the computer 110, the processing is performed which converts the color space from the RGB color space to YMCK color space (S102). By doing this, the processing of the color separation into yellow ink Y, magenta ink M, cyan ink C, and black ink K is performed, and the jection duty of each ink which is ejected onto the medium, is obtained for every ink color.

Next, the light absorption rate due to each ink is obtained, based on the ejection duty for every unit area of each ink color (S104). The light absorption rate is obtained, based on the "duty-light absorption rate conversion table" with respect to the ejection duty of each ink color. The duty-light absorption rate conversion table is a table where the light absorption rate per the unit area of each ink color is matched to the ejection duty of each ink color. For example, the comparatively high light absorption rate is also matched to the ink with the high light absorption rate, such as the cyan ink, even in a case where the ejection duty of the ink is low. On the other hand, for example, the comparatively low light absorption rate is also matched to the ink with the low light absorption rate, such as the yellow ink, even in a case where the ejection duty of the ink is high.

By doing this, when the light absorption rate with respect to each unit area in the medium is obtained, the ejection duty of the clear ink that is to be ejected onto that unit area according to the obtained light absorption rate is obtained (S106). The ejection duty of the clear ink is obtained, based on the "light absorption rate-ejection duty conversion table" with respect to the light absorption rate. The light absorption rate-ejection duty conversion table is a table where the amount of the clear ink C1 that has to be ejected, that is, the ejection duty of the clear ink C1, is matched to the light absorption rate in the unit area.

As described above, since a large amount of the clear ink C1 is ejected onto the ink with the low light absorption rate, the high ejection duty is matched to the low light absorption rate. Furthermore, the low ejection duty is matched to the high light absorption rate.

By doing this, the ejection duty of the clear ink C1 is obtained for every unit area of the medium. And the printing is performed according to the processing of the color separation and the ejection duty of the clear ink C1, which are described above (S108). Specifically, the head 41 is moved, and the metallic ink Me is ejected. And the metallic layer is formed. In addition, for the purpose of the ease of the description, it is assumed the metallic layer is formed on the entire surface of the medium.

In addition, the color image is ejected by moving the head 41 and thus the color image is formed on the metallic layer. Furthermore, the head 41 is further moved and the clear ink Cl is ejected onto the color image according to the obtained ejection duty.

By doing this, a large amount of the clear ink Cl may be ejected onto the color ink with the low light absorption rate. And the printed matter with the high security level, of which the copying is difficult to perform may be provided by increasing the rate of the specular reflection light.

Other Embodiments

According to the embodiment described above, while the droplets of the clear ink C1 are leveled on the color ink with the low light absorption rate, the clear ink C1 is hardened in the shape of a dot on the color ink with the high light absorption rate. And the shape of the clear ink Cl on the color ink is realized by adjusting the amount of the clear ink to be ejected. However, the shape of the clear ink C1 may also be changed differently a with other techniques.

For example, the clear ink C1 in use may be ultraviolet-hardened type ink, and additionally, an ultraviolet emitting device may be provided. Accordingly, when the ultraviolet waits until droplets of the clear ink Cl landed on the color ink are integrated into one piece and then is emitted, the droplets of the clear ink C1 are leveled. On the other hand, when the ultraviolet is emitted before the droplets of the clear ink C1 landed on the color ink are integrated into one piece, the droplets of the clear ink are hardened in a state of being at intervals without being leveled.

According to the embodiments described above, the printer 1 as the printing apparatus is described, but the invention is not limited to the printing apparatus and may be embodied as a liquid discharging apparatus that ejects or discharges fluids other than the ink (liquid, a liquid-state material in which particles of a functional material are distributed, and a fluid-state material like a gel). For example, the same technologies, as the embodiments described above, may be applied to various apparatuses to which the ink jet technology is applied, such as a color filter manufacturing apparatus, a dyeing apparatus, a micro processing apparatus, a semiconductor manufacturing apparatus, a surface treatment apparatus, a three-dimensional molding machine, a gas vaporization apparatus, an organic EL manufacturing apparatus (especially a high polymer EL manufacturing device), a display manufacturing apparatus, a film forming apparatus, a DNA chip manufacturing apparatus, and more. Furthermore, methods and manufacturing methods in use with these apparatuses are also in the range of the applications.

The purpose of the embodiment described above is to easily understand the invention, and is not interpreted to limit the invention. The invention may be modified and improved without deviating from the gist thereof, and it goes without saying that the invention includes the equivalents thereof.

On Head

According to the embodiments described above, the ink is ejected by using a piezoelectric element. However, the method of ejecting the liquid is not limited to this. For example, other methods, such as a method in which a bubble is generated within the nozzle by heat, may be employed.

What is claimed is:

1. A printing apparatus comprising:

a first nozzle through which to eject color ink;

a second nozzle through which to eject clear ink; and a control unit that performs control, in a manner that ejects the color ink onto a glittering ink layer through the first nozzle, and ejects the clear ink onto the color ink through the second nozzle, at the time of forming an image on a medium on which the glittering ink layer is formed, wherein the control unit controls ejection of the clear ink through the second nozzle in such a manner that an amount of the clear ink to be ejected onto the color ink varies inversely according to the light absorption rate of the color ink.

2. The printing apparatus according to claim 1, further comprising:

a third nozzle through which to eject glitter ink, wherein the control unit forms the glittering ink layer by ejecting the glitter ink through the third nozzle.

3. The printing apparatus according to claim 1, wherein the control unit performs the control in a manner that ejects a first amount of the clear ink onto the color ink with a first light absorption rate through the second nozzle and ejects a second amount of the clear ink, larger than the first amount, onto the color ink with a second light absorption rate, lower than the first light absorption rate, through the second nozzle.

4. The printing apparatus according to claim 3, wherein the control unit controls the ejection of the clear ink through the second nozzle in such a manner that droplets of the clear ink that land on the color ink with the second light absorption rate, are integrated into one piece on the color ink with the second light absorption rate.

5. The printing apparatus according to claim 3, wherein the control unit controls the ejection of the clear ink through the second nozzle in such a manner that droplets of the clear ink that land on the color ink with the first light absorption rate, are at intervals on the color ink with the first light absorption rate.

6. The printing apparatus according to claim 1, wherein the clear ink is ink that is hardened by light, further comprising: a light emitting unit that emits the light which hardens the clear ink.

7. A printing method comprising:

ejecting color ink onto a glittering ink layer on a medium on which the glittering ink layer is formed; and ejecting an amount of clear ink on the color ink that has an inverse relationship to the light absorption rate of the color ink.

8. A printed matter, comprising:

color ink ejected onto a glittering ink layer on a medium on which the glittering layer is formed, and clear ink ejected onto the color ink in an amount that has an inverse relationship to the light absorption rate of the color ink.

* * * * *